US007571998B2

(12) United States Patent
Reinten

(10) Patent No.: US 7,571,998 B2
(45) Date of Patent: Aug. 11, 2009

(54) PRINTING METHOD FOR PREVENTING AND/OR TREATING AIR BUBBLES IN AN INKJET PRINTER AND AN INKJET PRINTER WHICH HAS BEEN MODIFIED FOR THE PRINTING METHOD

(75) Inventor: Hans Reinten, Velden (NL)

(73) Assignee: Océ-Technologies B.V., Venlo (NL)

( * ) Notice: Subject to any disclaimer, the term of this patent is extended or adjusted under 35 U.S.C. 154(b) by 389 days.

(21) Appl. No.: 11/345,236

(22) Filed: Feb. 2, 2006

(65) Prior Publication Data

US 2006/0170743 A1 Aug. 3, 2006

(30) Foreign Application Priority Data

Feb. 3, 2005 (NL) ..... 1028178

(51) Int. Cl.
*B41J 2/19* (2006.01)

(52) U.S. Cl. ..... 347/92

(58) Field of Classification Search ..... 347/14, 347/19, 23, 68, 92
See application file for complete search history.

(56) References Cited

U.S. PATENT DOCUMENTS 4,323,908 A * 4/1982 Lee et al. ..... 347/27
4,466,005 A * 8/1984 Yoshimura ..... 347/9
4,498,088 A * 2/1985 Kanayama ..... 347/92
4,518,974 A * 5/1985 Isayama ..... 347/92
4,625,220 A * 11/1986 Nagashima ..... 347/19
4,695,852 A * 9/1987 Scardovi ..... 347/14
6,139,133 A * 10/2000 Ishikawa ..... 347/71
6,682,162 B2 * 1/2004 Simons et al. ..... 347/19

FOREIGN PATENT DOCUMENTS

EP 1 013 453 A2 6/2000
EP 1 013 453 A3 2/2001
JP 59-176053 A 10/1984
JP 63-295267 12/1988
JP 63-295267 A 12/1988
JP 64-78846 A 3/1989
JP 401078846 * 3/1989

* cited by examiner

*Primary Examiner*—Anh T. N. Vo
(74) *Attorney, Agent, or Firm*—Birch, Stewart, Kolasch & Birch, LLP

(57) ABSTRACT

A printing method for use with an inkjet printer containing a substantially closed ink duct including a nozzle, said duct being operationally connected to an electro-mechanical transducer, the presence of an air bubble in the duct is determined and the air bubble is subsequently eliminated, wherein the elimination of the air bubble takes place by actuating the transducer at a frequency which is lower than the frequency that corresponds to the size of the air bubble in equilibrium, and the amplitude is sufficient to arrange for the ink drops to be ejected from the nozzle. The invention also relates to an inkjet printer which has been modified to use the present method.

8 Claims, 6 Drawing Sheets

PRINTING METHOD FOR PREVENTING AND/OR TREATING AIR BUBBLES IN AN INKJET PRINTER AND AN INKJET PRINTER WHICH HAS BEEN MODIFIED FOR THE PRINTING METHOD

The present application claims priority under 35 U.S.C. §119 to The Netherlands Patent Application No.1028178 , filed Feb. 3, 2005, the entire contents of which are hereby incorporated by reference.

BACKGROUND OF THE INVENTION

The present invention relates to a printing method for an inkjet printer containing a substantially closed ink duct provided with a nozzle, said duct being operationally connected to an electro-mechanical transducer, said method comprising determining whether an air bubble is present in the duct and subsequently eliminating the air bubble. The invention also relates to an inkjet printer which utilizes the present method.

A method of this kind is known from European patent application 1 013 453. In such an inkjet printer, the presence of an air bubble in the ink duct is determined by the application of a piezo-electric transducer used as a sensor. Due to the fact that such an air bubble may adversely affect the ejection of an ink drop from the duct nozzle (the drop formation process), attempts have been made to eliminate air bubbles from the duct. To do this, various methods have been suggested in the prior art, such as flushing the duct with new ink or interrupting the printing process to allow the air bubbles to dissolve in the ink. A disadvantage of the first suggested method is that it involves a relatively high loss of ink. A disadvantage of the second suggested method is that it requires a relatively long period of time, i.e., up to several minutes, depending on the size of the air bubble, thereby requiring the printing process to be interrupted for long time periods.

SUMMARY OF THE INVENTION

The present invention obviates the above problems. To this end, a printing method has been developed whereby the elimination of bubbles in the duct takes place by actuating the transducer at a frequency which is lower than the frequency that corresponds to the size of the air bubble in equilibrium, and with an amplitude that is so large that ink drops are ejected from the nozzle.

The present invention is based on the recognition that the size of an air bubble, at a certain frequency at which the transducer of the associated duct is actuated, or at least as long as ink drops are ejected from the duct, will normally increase until it has reached an equilibrium. In other words, there is a correlation between the actuation frequency during ink drop ejection and the size that a bubble will reach in equilibrium in the associated ink duct. It has been found that an air bubble will quickly reach its equilibrium size when the transducer is actuated. The applicant has recognised that this may be used to quickly decrease the size of an air bubble. By choosing the actuation frequency such that it is lower than the frequency at which the air bubble is in equilibrium, the air bubble will, providing the amplitude of each actuation is such that ink drops are ejected from the duct, quickly decrease in volume so that its new size is in equilibrium at the lower frequency. By choosing a frequency that corresponds to a very small air bubble size, the original air bubble will quickly decrease in size until it has reached its new equilibrium size. Very small air bubbles are known not to have an adverse effect on the drop formation process so that the air bubble problem may be deemed to have been eliminated. Furthermore, very small air bubbles often tend to disappear quickly (typically within a second), as they are likely to be ejected from the duct together with the ink drops. The advantage of the present method is that air bubbles may now be eliminated very quickly. However, this does mean that ink is lost, as this method only appears to work adequately if ink drops are ejected from the duct while the air bubble is eliminated, though the amount is relatively small in comparison with the ink that is lost when the duct is flushed. Furthermore, the ejected ink drops may, in principle, be used when printing an image, so that no ink actually needs to be lost.

According to one embodiment, actuation at the chosen frequency is followed by actuation at a second frequency which is lower than the first frequency, where the amplitude is so large that ink drops are ejected from the nozzle. According to this embodiment, the air bubble is eliminated by shrinking it to its final size in at least two stages. Practice has shown that the air bubble may be eliminated even faster in this manner. The reason for this is not entirely clear but may be linked to the fact that a large air bubble shrinks relatively much faster to a new (smaller) equilibrium size if the new size deviates less from the original size. It may also be that the size of the air bubble would shrink faster at a higher frequency, as the dynamics in the duct would then also be greater.

According to another embodiment of the present invention, actuation at the second frequency is followed by actuation at one or more other frequencies, each with a lower value than the previous one, where the amplitude is so large that ink drops are ejected from the nozzle. According to this embodiment, the air bubble is eliminated by subjecting it to a series of decreasing frequencies that are slightly lower each time. It appears that a bubble may be eliminated very quickly in this manner. If sufficient small steps are applied, the air bubble virtually follows the equilibrium curve so that the dissolution process may be completed very quickly. However, this also depends on the geometry of the duct, the ink type, the nozzle shape, the actuation frequency during printing, etc. Experiments may easily determine the manner in which an air bubble may be eliminated in the fastest time (in three or four relatively large steps or, for example, several tens of small steps). Here, it may be advantageous to use the transducer as a sensor to follow the elimination process in real-time.

According to the present invention, actuation at one or more frequencies takes place until the bubble no longer adversely affects the operation of the inkjet printer. Accordingly, the bubble is shrunk to a size at which it no longer has a noticeable adverse effect on the operation of the printer, which also shows in the print quality. This embodiment has the advantage that the printing process may usually be resumed even faster. The size to which the bubble needs to be shrunk depends on the printer type, the ink and the geometry of the duct, but also on the image to be printed (adverse effects on the drop formation process may show in one image but not in another). Experiments may easily determine when an air bubble no longer adversely affects the print quality. In order to measure the bubble size, the transducer could be used as a sensor, as is known from the European patent application, referred to above.

The method described above is applied while an image is printed using the inkjet printer, where the printing process using the ink duct in the application of a regular print frequency is interrupted if the presence of an air bubble is determined to be present in this duct, after which the air bubble is eliminated by the application of one or more frequencies so that the air bubble reaches a size where it no longer adversely affects the printing process, after which the printing process is resumed using this duct by the application of the regular print frequency.

The present invention also relates to an inkjet printer containing a substantially closed duct in which ink is situated and which includes a nozzle, the duct being operationally connected to an electro-mechanical transducer. The printer contains a controller embodied in such a manner that it may actuate the printer in order to carry out the method described above. According to this embodiment, the printer comprises a control unit (controller), e.g., embodied as a programmable unit, which is capable of actuating the printer according to the method described above. The programmable unit may consist of one or more dedicated ICs (ASICs) and one or more processors that may be software-programmed. It should be understood that this control unit does not need to be one single designatable unit in the printer but may also be composed of several complementary components distributed across the printer.

BRIEF DESCRIPTION OF THE DRAWINGS

The present invention will now be further explained with reference to the following figures, wherein.

DETAILED DESCRIPTION OF THE INVENTION

Figure 1:
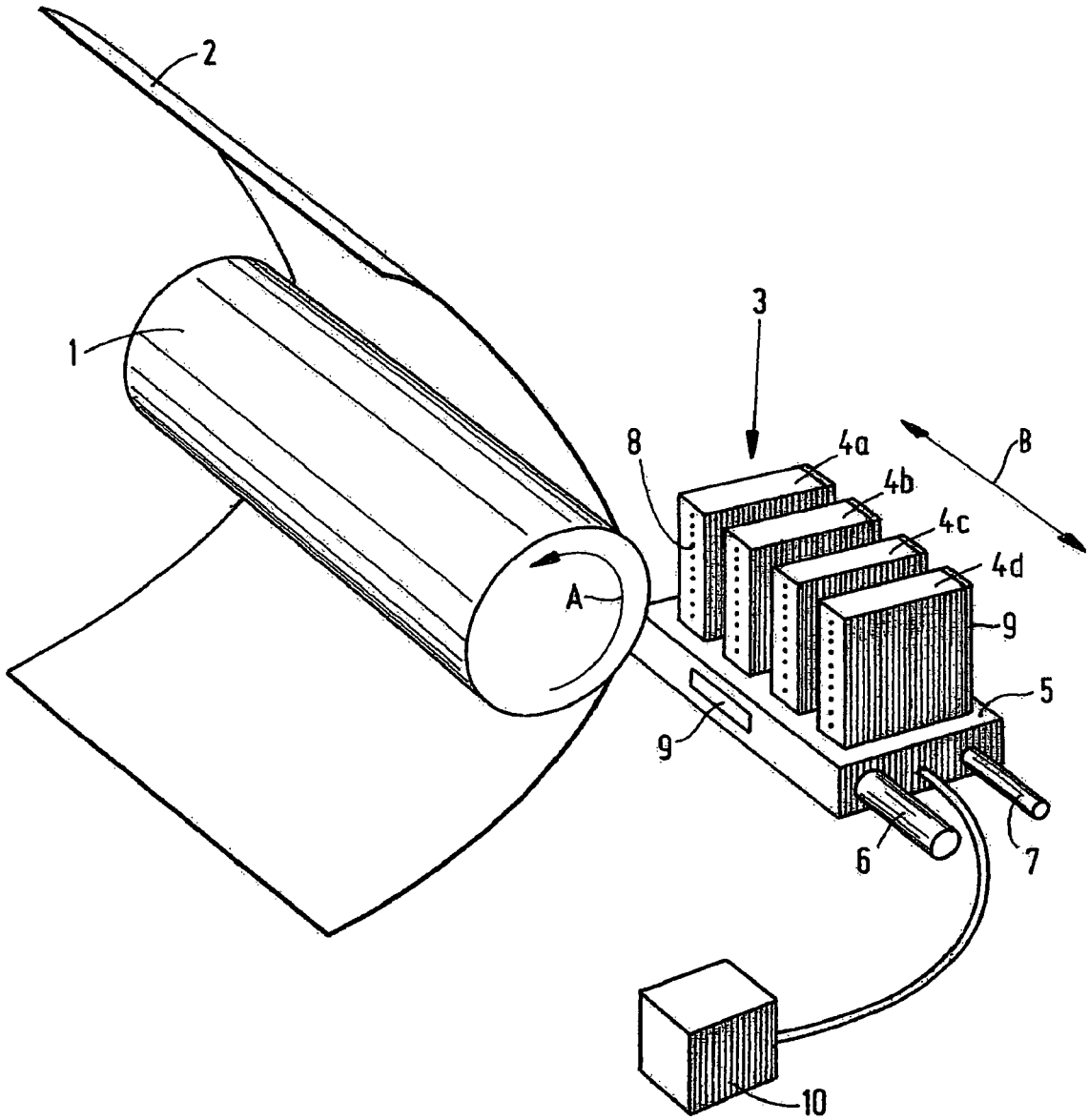
FIG. 1 is a diagram showing an inkjet printer.

FIG. 1 is a diagram showing an inkjet printer. According to this embodiment, the printer comprises a roller 1 used to support a receiving medium 2, such as a sheet of paper or a transparency, which moves accross the carriage 3. This carriage includes a carrier 5 to which four printheads 4*a*, 4*b*, 4*c* and 4*d* have been fitted. Each printhead contains its own color, in this case cyan (C), magenta (M), yellow (Y) and black (K) respectively. The printheads are heated using heating elements 9, which have been fitted to the rear of each printhead 4 and to the carrier 5. The temperature of the printheads is maintained at the correct level by the application of a central control unit 10 (controller).

The roller 1 may rotate around its own axis as indicated by arrow A. In this manner, the receiving medium may be moved in the sub-scanning direction (often referred to as the X direction) relative to the carrier 5, and therefore also relative to the printheads 4. The carriage 3 may be moved in reciprocation, using suitable drive mechanisms (not shown), in a direction indicated by double arrow B, parallel to roller 1. To this end, the carrier 5 is moved across the guide rods 6 and 7. This direction is often referred to as the main scanning direction or Y direction. In this manner, the receiving medium may be fully scanned by the printheads 4.

According to the embodiment as shown in this figure, each printhead 4 comprises a number of internal ink ducts (not shown), each with its own exit opening (nozzle) 8. The nozzles in this embodiment form one row per printhead perpendicular to the axis of roller 1 (i.e., the row extends in the sub-scanning direction). In a practical embodiment of an inkjet printer, the number of ink ducts per printhead will be many times greater and the nozzles will be arranged over two or more rows. Each ink duct comprises a piezo-electric transducer (not shown) that generates a pressure wave in the ink duct so that an ink drop is ejected from the nozzle of the associated duct in the direction of the receiving medium. The transducers may be actuated, image-wise, via an associated electrical drive circuit (not shown) by the application of the central control unit 10. In this manner, an image built up of ink drops may be formed on receiving medium 2.

If a receiving medium is printed using such a printer where ink drops are ejected from ink ducts, this receiving medium, or a part thereof, is imaginarily split into fixed locations that form a regular field of pixel rows and pixel columns. According to one embodiment, the pixel rows are perpendicular to the pixel columns. The individual locations thus produced may each be provided with one or more ink drops. The number of locations per unit of length in the directions parallel to the pixel rows and pixel columns is called the resolution of the printed image, for example, indicated as 400×600 d.p.i. ("dots per inch"). By actuating a row of printhead nozzles of the inkjet printer image-wise when it is moved relative to the receiving medium as the carrier 5 moves, an image, or part thereof, built up of ink drops is formed on the receiving medium, or at least in a strip as wide as the length of the nozzle row.

Figure 2:
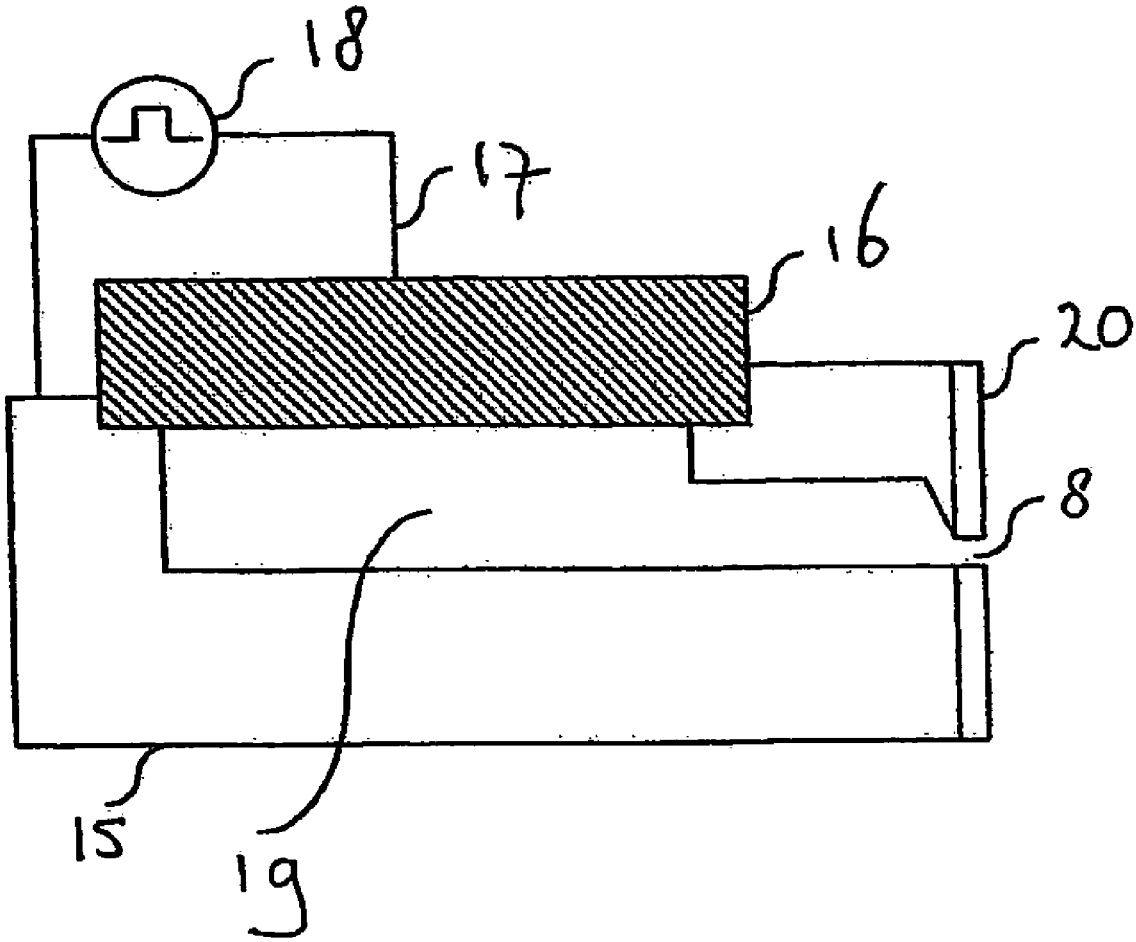
FIG. 2 is a diagram showing an ink duct assembly and its associated transducer.

FIG. 2 shows an ink duct 19 comprising a piezo-electric transducer 16. Ink duct 19 is formed by a groove in base plate 15 and is limited at the top mainly by piezo-electric transducer 16. Ink duct 19 extends into an exit opening 8 disposed at the end thereof, the opening being partially formed by a nozzle plate 20 in which a recess is provided at the level of the duct. When a pulse is applied across transducer 16 by a pulse generator 18 via actuation circuit 17, the transducer bends in the direction of the duct. This produces a sudden pressure rise in the duct, which in turn generates a pressure wave in the duct. According to an alternative embodiment, the transducer first bends away from the duct, thus sucking in ink via an inlet opening (not shown), after which the transducer is moved back into its initial position. This also produces a pressure wave in the duct. If the pressure wave is strong enough, an ink drop is ejected from exit opening 8. After the expiration of the ink drop ejection process, the pressure wave, or a part thereof, is still present in the duct, but will eventually dampen fully over time. The pressure wave, in turn, results in a deformation of transducer 16, which then generates an electric signal. This signal depends on all the parameters that influence the generation and the damping of the pressure wave. In this manner, as known from European patent application EP 1 013 453, it is possible by measuring this signal, to obtain information on these parameters, such as the presence of air bubbles or other undesirable obstructions in the duct. This information may then, in turn, be used to check and control the printing process.

Figure 3:
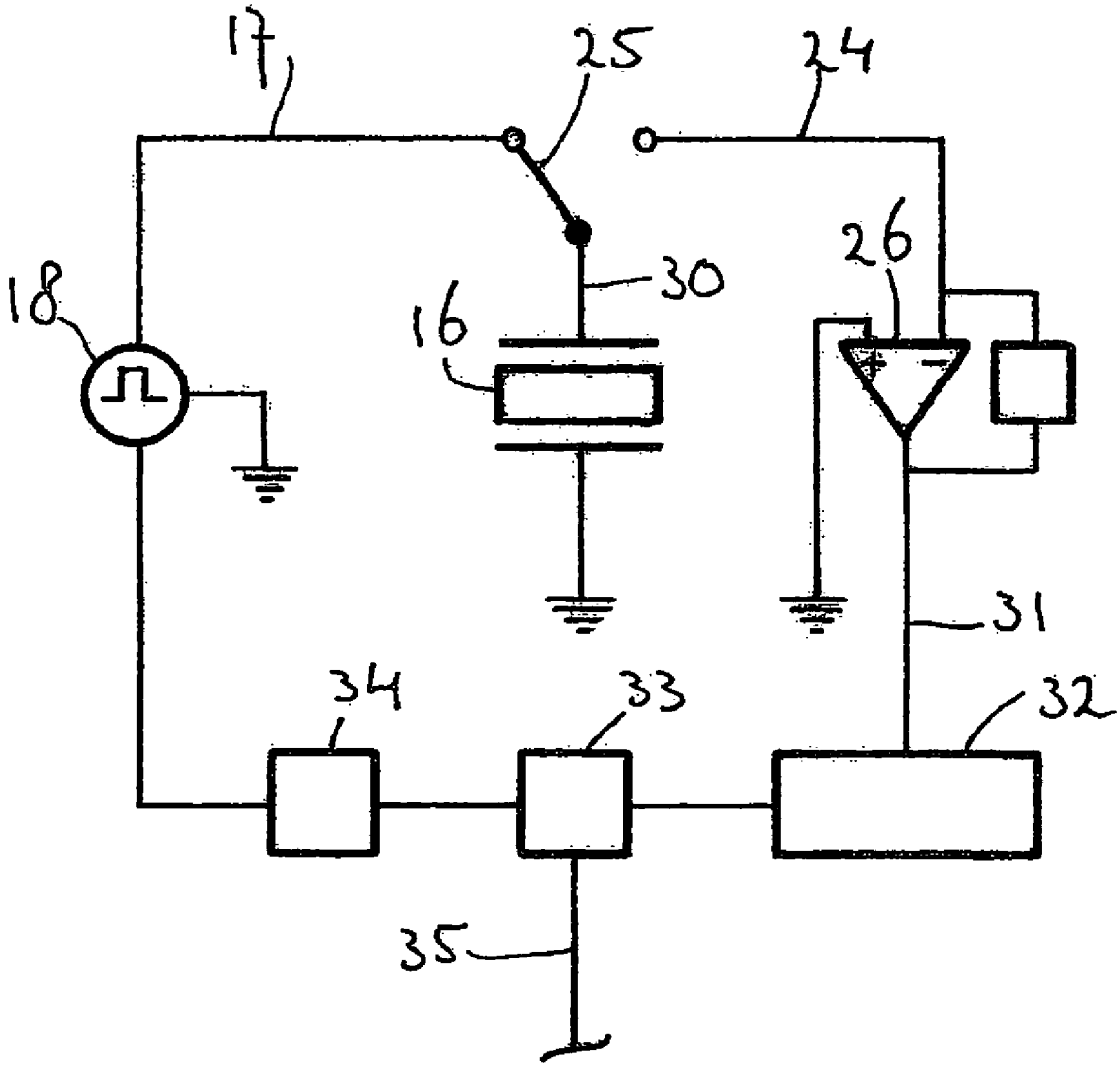
FIG. 3 is a block diagram showing a circuit that is suitable for measuring the state in the ink duct by application of the transducer used as a sensor.

FIG. 3 is a block diagram showing the piezo-electric transducer 16, the actuation circuit (items 17, 25, 30, 16 and 18), the measuring circuit (items 16, 30, 25, 24, and 26) and control unit 33, according to one embodiment. The actuation circuit, containing a pulse generator 18, and the measuring circuit, containing an amplifier 26, are connected to transducer 16 via a common line 30. The circuits are opened and closed by two-way switch 25. Once a pulse has been applied across transducer 16 by pulse generator 18, transducer 16 is in turn deformed by the resulting pressure wave in the ink duct. This deformation is converted into an electrical signal by transducer 16. After expiration of the actual actuation, two-way switch 25 is converted so that the actuation circuit is opened and the measuring circuit is closed. The electric signal generated by the transducer is received by amplifier 26 via line 24. According to this embodiment, the resulting voltage is fed via line 31 to A/D converter 32, which offers the signal to control unit 33. This is where the measured signal is analyzed. If necessary, a signal is sent to pulse generator 18 via D/A converter 34 so that a subsequent actuation pulse is modified to the current state of the duct. Control unit 33 is connected to the central control unit of the printer (not shown in this figure) via line 35, allowing information to be exchanged with the rest of the printer and/or the outside world.

Figure 4:
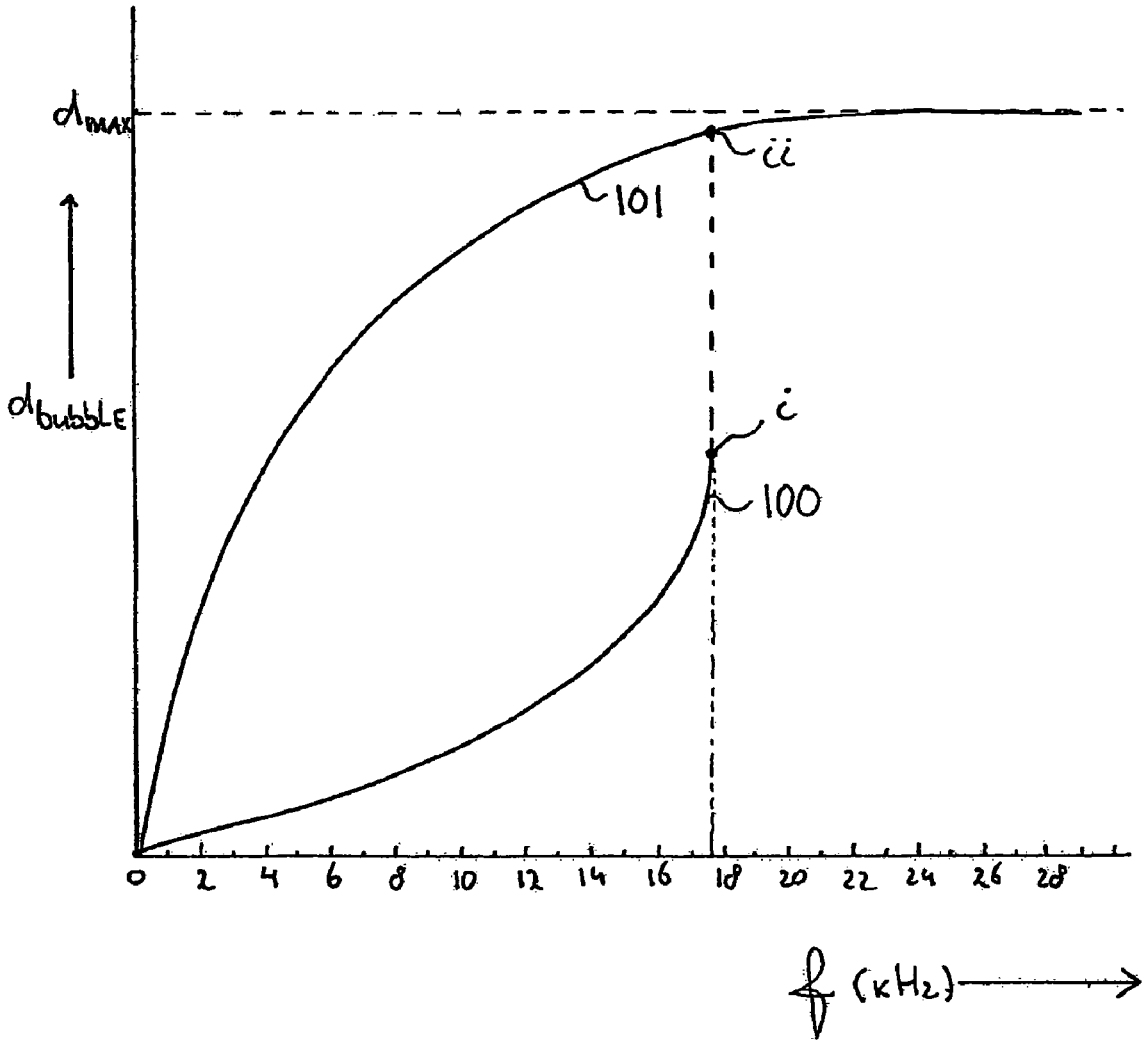
FIG. 4 shows the correlation between the size of an air bubble and the actuation frequency in equilibrium.

FIG. 4 shows a correlation 100 for the inkjet printhead as described in connection with FIG. 1, between the size of an air bubble (vertical axis, arbitrary units) and the frequency with which the transducer of the duct with the air bubble is actuated (horizontal axis in kilohertz), where an equilibrium exists and ink drops are ejected from the duct nozzle as a result of the actuation. It has been determined that the size of an air bubble in an ink duct of which the transducer is actuated at a certain frequency will normally increase to a certain level due to said actuations (i.e., in equilibrium). The position of this equilibrium correlation depends on whether or not ink drops are ejected during actuation. If ink drops are ejected as a result of the actuation, the equilibrium follows curve 100. It may be seen that the curve continues up to approximately 17,500 Hz (indicated by "i" in the figure). At this frequency, the air bubble present will just not inhibit the ink drop ejection from the duct. If the frequency increases a tiny bit more, ink drops will no longer be ejected, causing the size of the air bubble to increase very quickly until it reaches curve 101 (indicated by 'ii' in the figure). Curve 101 shows the equilibrium between the size of an air bubble and the frequency when no ink drops are ejected. It has been shown that as long as ink drops are ejected from the duct, the equilibrium size of an air bubble at a certain frequency is substantially lower than when ink drops are no longer ejected. This is probably due to the fact that when no ink drops are ejected, there is little or no ink flow in the duct so that the dissolution of gas from the air bubble is strongly inhibited.

The exact position of the curves depends on many factors such as the geometries of the duct and the nozzle, the ink type, the temperature of the printhead, etc. For the printhead in the example given, maximum air bubble size $d_{max}$ is achieved (at least in equilibrium and when ink drop ejection is inhibited) at a frequency that is approximately equal to 22,000 Hz. This bubble size $d_{max}$ is, in fact, equal to the diameter of the ink duct.

Figure 5:
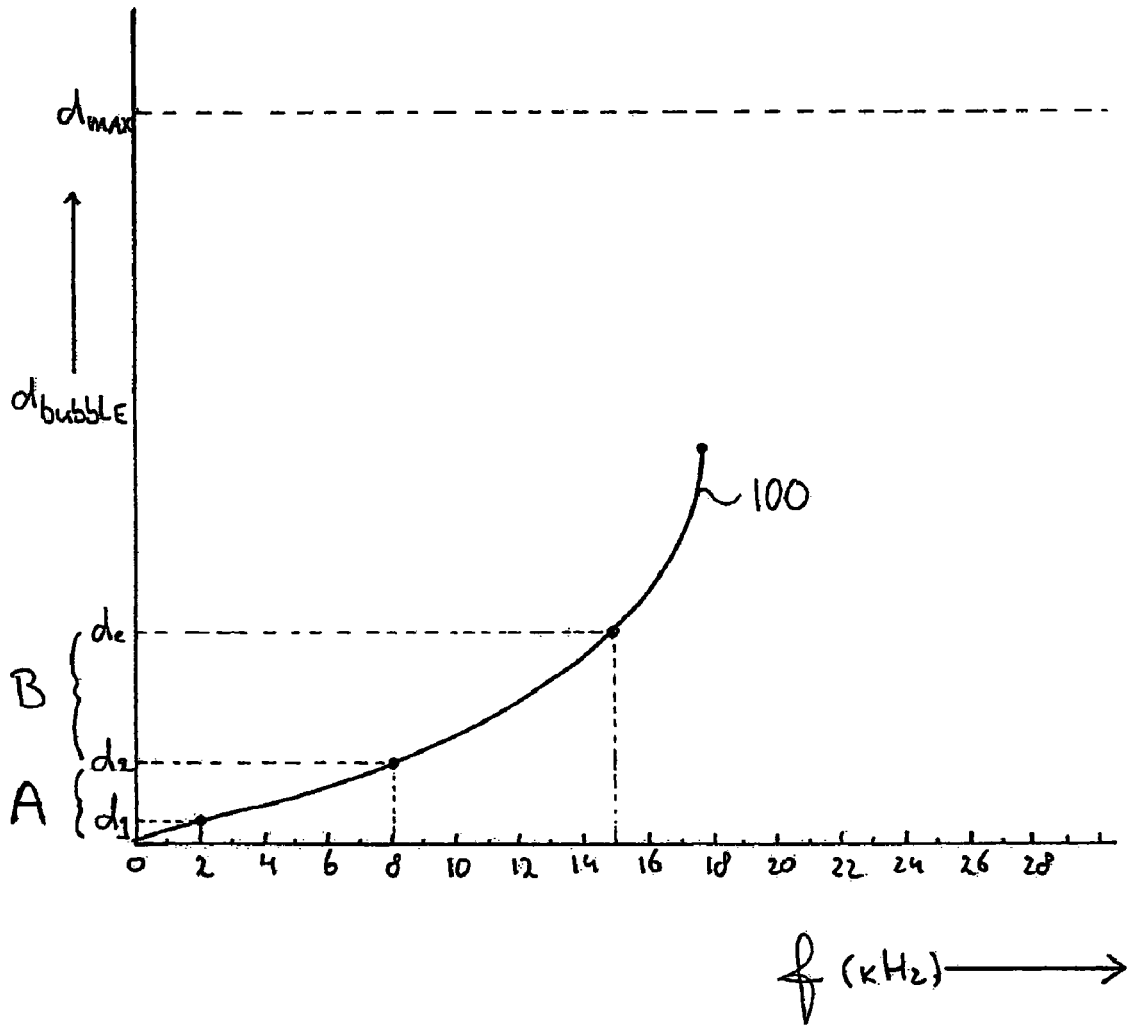
FIG. 5 shows the manner in which an air bubble may be eliminated.

FIG. 5 shows correlation 100 again. In this example, an ink duct of an inkjet printhead is actuated at a frequency of 15,000 Hz, associated with an equilibrium bubble size equal to $d_e$. In this printhead, the presence of an air bubble in the duct is determined after each scan of the print carriage (see FIG. 1), by analysis of the state of the duct (as described in connection with FIGS. 2 and 3). If this appears to be the case, this air bubble will most likely have a size in the region of equilibrium size $d_e$, or otherwise at least have a size which is in the area indicated by B, as the air bubble has had some time to increase to its equilibrium size while the scan was made.

According to this embodiment, the exact air bubble size is not known, nor is the position of the curve. The air bubble is presumed to have a size which is in area B. This presumption will be correct in most cases. In order to eliminate the air bubble, the regular (i.e., originally planned) printing process is temporarily interrupted and the transducer of the duct in question is actuated for 20 seconds at a frequency of 8,000 Hz, where the amplitude of each pulse is such that an ink drop is ejected from the duct. The ink drops in this embodiment are not used to continue printing the image, but collected as waste in a waste tank. These actuations will cause the air bubble to shrink to a size $d_2$. Next, the transducer will be actuated for 10 seconds at a frequency of 2,000 Hz, again at an amplitude that is substantial enough for ink drops to be ejected from the duct. This will cause the air bubble to further shrink to a size $d_1$. An air bubble with the latter size may be deemed to have been substantially eliminated as it is so small that it will not adversely affect the printing process and will usually disappear quickly during printing, for example by being ejected from the duct together with an ink drop. Next, the regular printing process will be resumed. According to an alternative embodiment, the ink drops which are ejected while the air bubble is eliminated are used to continue to print the image.

It will be understood by those skilled in the art, that it is not necessary to know the exact size of an air bubble for it to be eliminated according to the present invention. Even if the air bubble in the example given initially had a size between $d_1$ and $d_2$ (area A), it would still have been eliminated by application of the present method. This would mean, however, that the size of this air bubble would probably first have been increased to a size $d_2$ by the application of the first series of pulses, but after that this bubble would shrink to a size $d_1$ by the actuation of the transducer at a frequency of 2,000 Hz, this frequency being below the equilibrium frequency of 8,000 Hz that is associated with a size $d_2$. Nor is it necessary to know the position of the equilibrium curve 100. Since it is now known that such a correlation exists, it is possible to make use of the fact that there is an equilibrium size for an air bubble at each frequency.

Figure 6:
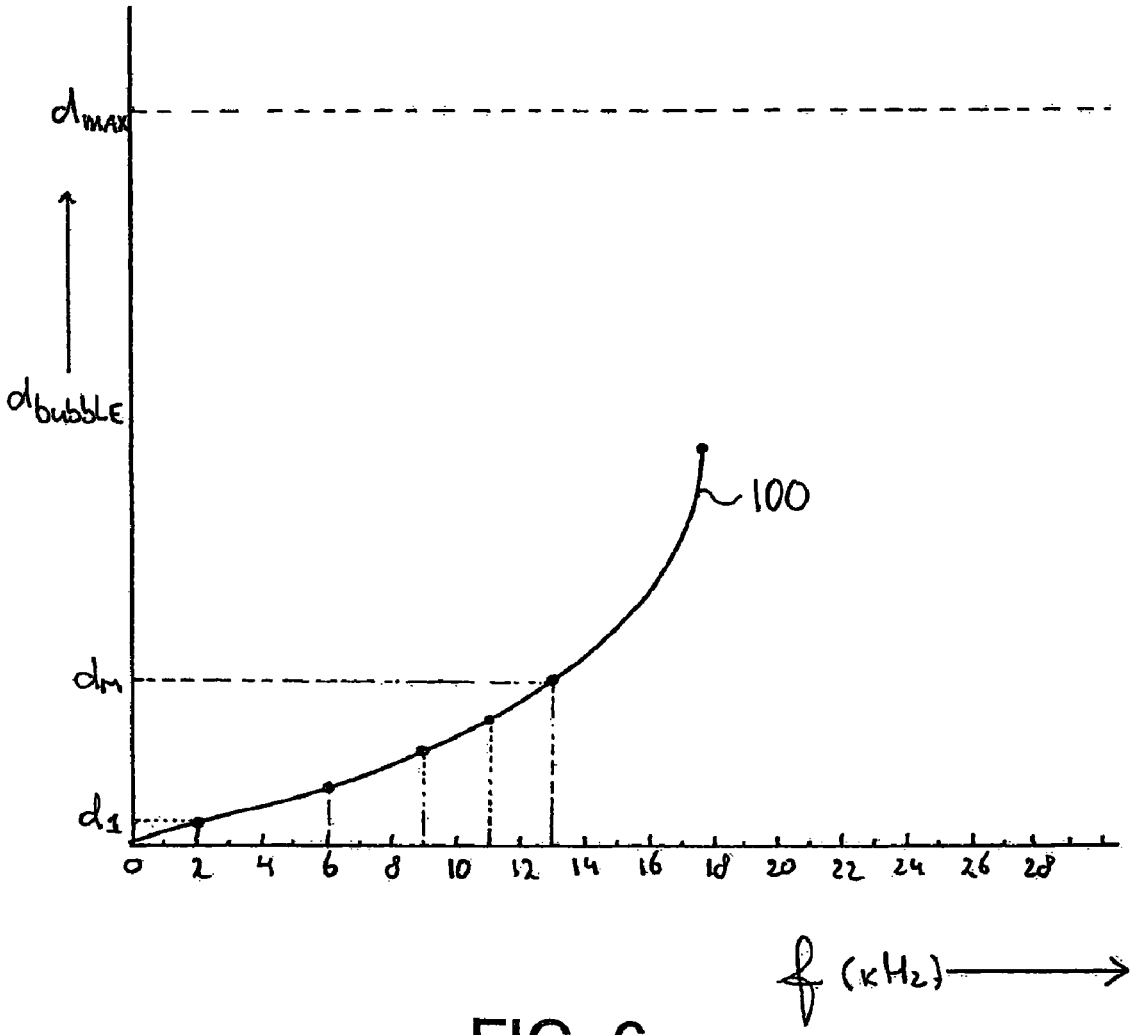
FIG. 6 gives a second example of the elimination of an air bubble.

FIG. 6 shows a method that may be applied when the exact air bubble size and the correlation between the air bubble size and the frequency at equilibrium (100) are known. The size of an air bubble may, for example, be derived from analyzing the signal generated by the transducer when the latter is used as a sensor (see FIGS. 2 and 3). As the size of the air bubble is an important parameter for the acoustics in the duct, this size may be derived by the application of a simple model for these acoustics by measuring the pressure wave present in the duct after the associated transducer has been actuated. As is generally known, the pressure wave is directly dependent on the acoustics in the duct.

In the example given, the duct is also operated at an actuation frequency of 15,000 Hz. However, at the time when the air bubble is detected, it has a size $d_m$, which is associated with an equilibrium frequency of 13,000 Hz. In this example, the transducer of this duct is actuated for 4 seconds at a frequency of 11,000 Hz (where the amplitude is such that ink drops are still ejected). Next, the frequency is decreased in stages to 2,000 Hz via 9,000 and 6,000 Hz. At each frequency, the transducer is actuated for 4 seconds when ink drops are ejected from the duct. It appears that the air bubble virtually follows the equilibrium curve as a result and reaches a size equal to $d_1$ within the total actuation time of 16 seconds. The air bubble may then be deemed to have been eliminated. It will be understood by those skilled in the art that there are several ways to shrink an air bubble to a size at which the air bubble may be deemed to have been eliminated. Tests may easily determine the optimal number of steps that needs to be taken in order to achieve this objective.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A printing method for an inkjet printer containing a substantially closed ink duct provided with a nozzle, said duct being operationally connected to an electro-mechanical transducer, which is configured to be actuated with an actuation pulse having an actuation frequency and an actuation amplitude for generating a pressure wave in the duct, the pressure wave having a pressure frequency and a pressure amplitude, said method comprising the steps of:

a) determining a presence of an air bubble in the ink duct, b) determining a size of the air bubble, c) determining an equilibrium frequency associated with the air bubble in equilibrium with said size the air bubble, d) actuating the transducer with at least one actuation pulse, having a frequency which is lower than the frequency determined in step c) and having an amplitude which is so large that ink drops are ejected from the nozzle for eliminating the air bubble.

2. The method according to claim 1, wherein the actuation is conducted with a pulse having a first actuation frequency and a second actuation subsequent to the first actuation with a pulse having a second actuation frequency, the second actuation frequency being lower than the first actuation frequency, and the pulse having an amplitude that is so large that ink drops are ejected from the nozzle.

3. The method according to claim 2 wherein the second actuation is followed by one or more further actuation(s) with pulses each having an actuation frequency lower than each preceding actuation frequency, and each pulse having an amplitude that is so large that ink drops are ejected from the nozzle.

4. The method according to claim 3, wherein the one or more actuation(s) take place for as long as it is necessary for the air bubble to lose its adverse effect on the operation of the inkjet printer.

5. The method according to claim 1, wherein the transducer is used as a sensor to determine the size of the air bubble.

6. The method according to claim 1, the steps of which are applied while an image is being printed using the ink duct of the inkjet printer, the printing of the image comprising the steps of;

a) printing by conducting actuations with a pulse having a regular print frequency, b) interrupting the printing where the presence of an air bubble in the duct is detected, c) conducting one or more actuations with a pulse having an actuation frequency lower than the regular print frequency until the air bubble reaches a size at which it no longer aversely affects the printing, and d) resuming the printing using the duct by conducting actuations with a pulse having its regular print frequency.

7. An inkjet printer containing a substantially closed duct in which ink is situated and which contains a nozzle, said duct being operationally connected to an electro-mechanical transducer, the printer including a controller which is configured for controlling the inkjet printer to perform the steps of the method of claim 1.

8. The method according to claim 1, wherein the step of determining the size of the air bubble comprises the steps of:

a) determining a first size of an air bubble, this air bubble being in equilibrium at the actuation frequency, b) determining a second size of an air bubble, this air bubble being in equilibrium at a lower actuation frequency than the actuation frequency of step a).

c) presuming the actual size of the air bubble to be smaller than the first size and larger than the second size, actuating the transducer with the at least one actuation pulse, having a frequency equal to the lower actuation frequency of step b).

* * * * *